US005882249A

United States Patent [19]

Ferland

[11] Patent Number: 5,882,249

[45] Date of Patent: Mar. 16, 1999

[54] CONCRETE FINISHING MACHINE

[76] Inventor: Marc Ferland, 185 Boulevard 138, Saint-tite-des-caps, Canada, G0A-4j0

[21] Appl. No.: 966,570

[22] Filed: Nov. 10, 1997

[51] Int. Cl.[6] ..... B24B 41/00

[52] U.S. Cl. ..... 451/359

[58] Field of Search ..... 451/359, 357, 451/354, 360, 344, 353, 158, 259, 548

[56] References Cited

U.S. PATENT DOCUMENTS

| | | | |
|---|---|---|---|
| D. 161,484 | 1/1951 | McQuown | 451/359 |
| 589,006 | 8/1897 | Manning | 451/359 |
| 700,642 | 5/1902 | Hanford | 451/359 |
| 1,951,964 | 3/1934 | Burleigh et al. | 451/359 |
| 1,953,983 | 4/1934 | Benner | 451/359 |
| 1,983,277 | 12/1934 | Emmons | 451/359 |
| 2,552,471 | 5/1951 | Watkins | 451/359 |
| 2,702,395 | 2/1955 | Zaiger | 451/359 |
| 2,860,506 | 11/1958 | Drummond . | |
| 3,334,448 | 8/1967 | Alexander | 451/359 |
| 3,775,911 | 12/1973 | Flagge | 451/359 |
| 4,780,992 | 11/1988 | McKervey . | |
| 4,905,772 | 3/1990 | Honsa et al. | 451/359 |
| 5,147,146 | 9/1992 | Harding, Jr. . | |
| 5,221,156 | 6/1993 | Martin . | |
| 5,231,727 | 8/1993 | Armruster | 451/359 |
| 5,372,452 | 12/1994 | Hodgson . | |
| 5,678,272 | 10/1997 | McCracken et al. | 451/359 |

*Primary Examiner*—David A. Scherbel
*Assistant Examiner*—Derris H. Banks
*Attorney, Agent, or Firm*—Terrance L. Siemens

[57] ABSTRACT

An improved machine for finishing or floating concrete that has been sprayed or blown onto walls or structures. A flat rotating surface is held against the concrete to be finished and a variable speed control is manipulated by the user to smooth and finish the work. The handle of the invention extends radially on opposite sides of the power take off and lies within a plane normal to the axis between the motor and the rotating disk. This plane also passes through the center of gravity between the motor or power means and the rotating working surface. A variable speed control is disposed on the handle to allow the user to vary the revolutions of the float surface. The novel construction of the device allows the user to finish concrete surfaces more quickly and with less strain on shoulders and arms than is presently provided for with either manual floating or prior art tools.

3 Claims, 2 Drawing Sheets

CONCRETE FINISHING MACHINE

BACKGROUND OF THE INVENTION

1. Field of the Invention

The present invention relates to finishing tools. More specifically, it relates to a finishing tool for concrete with a power driven single rotating surface. A handle means is located intermediate the power means and the rotating work engaging surface. More generally, the invention relates to any situation where the user needs to ablate, abrade, or smooth a vertical or overhung surface for extended periods of time.

2. Description of the Prior Art

In the repair or installation of concrete, stucco, or the like, the concrete material is blown onto the surface that is being treated. After this is accomplished, a worker comes along to finish or smooth the dried or partially dried material. This smoothing or finishing is commonly done by hand, is time consuming, and can lead to physical problems for the worker from the strain of having to manipulate the work material with arms outstretched or extended above their head. Additionally, this work finishing is very time consuming, leading to high labor costs for the contractor. The present invention seeks to alleviate this problem by providing a finishing tool that is easily manipulated by the finisher and that allows them to complete the work in a much timelier manner than is currently provided for in the art. The position of the handles in the present invention allows the user to hold the rotating finishing surface against a vertical or semi-vertical wall with greater ease and comfort because of the location of the handles in a side by side relationship proximate to the center of gravity of the drive shaft intermediate of the motor means and the rotating finishing surface.

A number of relevant patents were found in a search at the U.S. Patent and Trademark Office and they are discussed hereinafter:

U.S. Pat. No. 2,860,506 issued on Nov. 18, 1958 to John D. Drummond discloses a power driven plastering trowel. This is clearly unlike the present invention in that the combination of power means base and radially extending handles taught in the present invention is not shown.

Next in this discussion is U.S. Pat. No. 4,780,992 issued on Nov. 1, 1988 to Roy P. McKervey. This is an apparatus for cleaning pool tile. This is dissimilar from the present invention in that it is designed as a conversion for an existing "weed-eater" or like device and that the novel handle means and engine support of the instant invention is not seen.

Another patent of interest is U.S. Pat. No. 5,147,146 issued on Sep. 15, 1992 to Edward M. Harding, Jr. This is a variable pitch power trowel. Unlike the present invention, as in the patents mentioned above, the unique construction of the radially disposed handle is not disclosed.

The next patent in this discussion is U.S. Pat. No. 5,221,156 issued on Jun. 22, 1993 to Harian S. Martin. This is a concrete finishing machine that is unlike the present invention in that the radially disposed handle and engine support is not seen.

Lastly, U.S. Pat. No. 5,372,452 issued on Dec. 13, 1994 to James A. Hodgson discloses a power trowel. As in other patents mentioned above the novel handle of the instant invention is not taught.

None of the above inventions and patents, taken either singly or in combination, is seen to describe the instant invention as claimed.

SUMMARY OF THE INVENTION

The present invention provides an improved machine for finishing or floating concrete that has been sprayed or blown onto walls or structures. A flat rotating surface is held against the concrete to be finished and a variable speed control is manipulated by the user to smooth and finish the work. The handle of the invention extends radially on opposite sides of the power take off and lies within a plane normal to the central axis and passing through the center of gravity between the motor or power means and the rotating working surface. A variable speed control is disposed on the handle to allow the user to vary the revolutions of the float surface. The novel construction of the device allows the user to finish concrete surfaces more quickly and with less strain on shoulders and arms than is presently provided for with either manual floating or prior art tools.

Accordingly, it is a principal object of the invention to provide a concrete finishing tool that can be used for an extended period of time without causing undue strain on the shoulders or arms of the user.

It is another object of the invention to provide a concrete finishing tool that substantially lessens the time required to "float" or finish a given section of sprayed concrete.

It is a further object of the invention that the concrete finishing tool have handle means that extend radially from the central power shaft.

Still another object of the invention is to provide a concrete finishing tool where the radially extending handles lie in the plane of the center of gravity between the motor and the rotating work contact surface.

These and other objects of the present invention will become readily apparent upon further review of the following specification and drawings.

BRIEF DESCRIPTION OF THE DRAWING

Various other objects, features, and attendant advantages of the present invention will become more fully appreciated as the same becomes better understood when considered in conjunction with the accompanying drawing, in which like reference characters designate the same or similar parts throughout the several views, and wherein.

DETAILED DESCRIPTION OF THE PREFERRED EMBODIMENT

Figure 1:
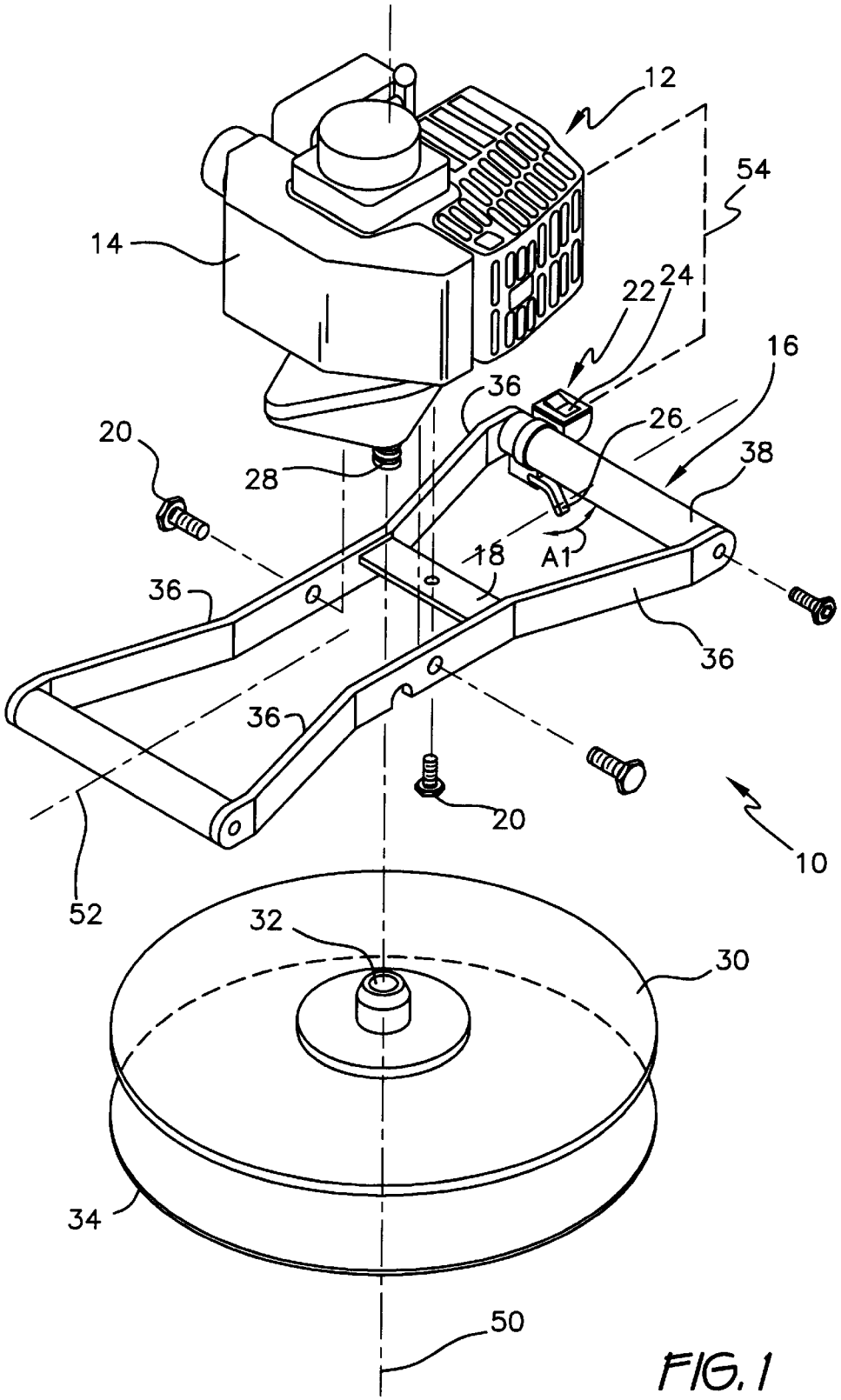
FIG. 1 is an exploded perspective view of the present invention showing the details of its construction, assembly, and the novel geometry of the handles.
Figure 2:
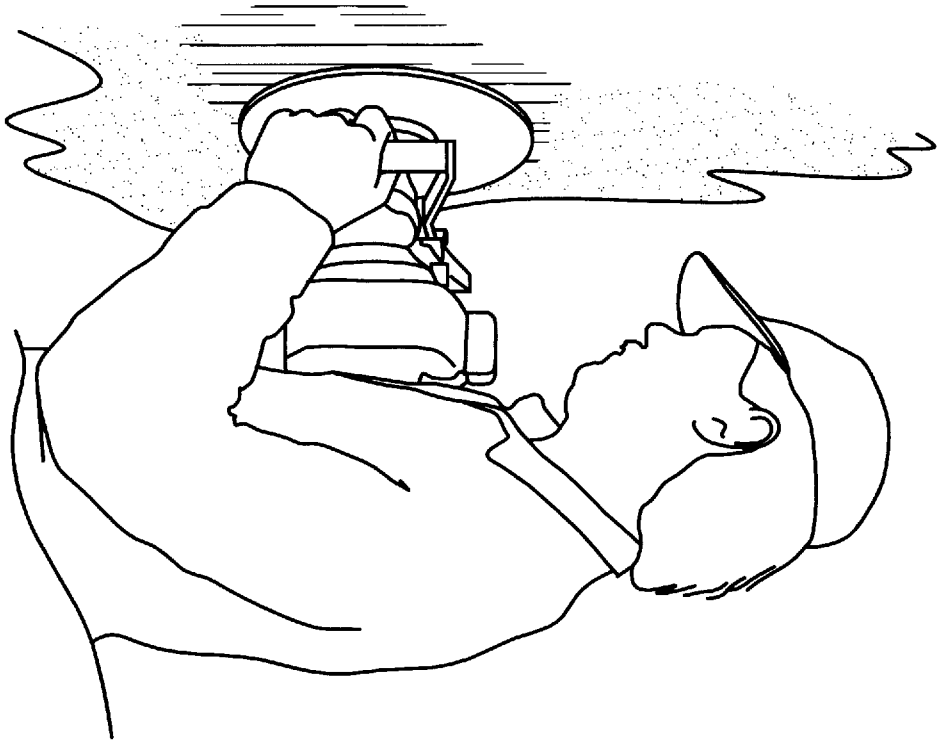
FIG. 2 is an environmental perspective view of the invention in use.

The present invention is indicated at 10 in FIG. 1. The motor is indicated at 12, and has a fuel tank 14. It should be noted that though an internal combustion engine is shown in the Figures and is described in this specification, other types of motors could be used. These different types would be obvious to a skilled practitioner, as different environments would call out for them. In an enclosed space, for example, an electrical motor could be used to obviate the hazards of the exhaust fumes generated by such an fuel burning engine. In the embodiment described herein, however, an internal combustion engine is seen. An example of the type of engine that could be used for this purpose is the type used in the Tanaka TED-262L drill. This has a 26 cc displacement, generates 1.3 HP at 8500 RPM, and has an electronic ignition.

The engine or motor 12 is attached to a handle 16. Handle 16 includes a motor support 18, and in the embodiment described herein, is attached to the motor 12 by threaded fasteners indicated at 20. The handle means 16 includes struts 36 and terminal grips 38. At one of the distal ends of the handle 16 attached proximate one of the grips 38, there is the control means 22. This includes an ignition switch 24 and a variable speed control 26. These are connected to motor means 12 and are used to respectively, start and control the speed of the power shaft 28. This connection is indicated schematically at the dotted line 54. This connection 54 is of a conventional type. Power shaft 28 is then connected to a plaque or disk 30. Disk 30 is circular in shape. This is preferably done by threaded means as indicated at 32. Thus, when motor 12 is started through ignition switch 24, the speed at which plaque or disk 30 will rotate is controlled by manipulating variable speed control 26 as indicated by directional arrow Al. Fastened to the plaque or disk 30 is the float material 34. This is attached, in the preferred embodiment, by contact cement, and is made of a softer material than the metal of the plaque or disk 30. Regarding the metal that the components of finishing tool 10 is made of, it is contemplated that 6061T Aluminum with a clear anodized finish would be used as it is both attractive and durable.

The handle 16 is placed such that it lies in the same plane as that normal to the axis 50 and passing through the center of gravity in regards to the motor 12 and plaque or disk 30 with the power shaft 28 extending between them. Grips 38 are each disposed at one end of handle 16 and are disposed diametrically opposed from one another on opposing sides of rotational axis 50 of power shaft 28. Thus, the user could balance the concrete finishing tool 10 easily by cupping two collinear handle struts 36 and letting the device 10 rest thereon. The unique construction of the handle 16 in relation to the rest of the device 10 allows for extended periods of use while minimizing fatigue or strain on the user.

For illustrative purposes, the axis along the power shaft is indicated in FIG. 1 as 50, and the second, perpendicular axis is indicated at 52. This second axis 52 lies within the plane normal to the center of gravity between the motor means 12 and the plaque or disk 30.

With the present invention, the finishing of blown concrete, stucco, and the like becomes much more efficient. Previously, the operator would have to use a manual floater made of wood, rubber, or other material. Using circular movements, the finisher would slowly move about one and a half inches every three rotations. For a surface of any size, thousands of these cycles are required, leading to possible shoulder or elbow pain in the future. Additionally, ennui becomes an issue and quality can suffer along with the amount of time one must pay a workman to perform this task. With the present invention however, the user simply starts at, say, the upper left hand corner of the surface to be finished. By moving the rotating plaque or disk 30 with its attached float material 34 horizontally in contact with the wall the user would continue for about five feet. The rotating work surface is then lowered its own width and the user guides it back. Reaching directly below the starting point, the user then raises the rotating work surface half its width and again reverses direction. It is estimated that for a surface fifteen feet long and five feet wide, the user would do thirty to thirty five lengths. Finishing time is cut in half. Another benefit of the present invention is that not only does it save time and enhances the appearance of the finished work, but it also, through the shearing action of the disk as it rotates in contact with the concrete, creates small air spaces in the surface. This increases the durability of the surface. If an air-entraining admixture is introduced into the concrete, this increase is enhanced. Generally, the use of the device is seen to improve the overall quality of the work.

It is also contemplated that the present invention could be adapted to finish overhead surfaces by extending the power shaft. Additionally, in this adaptation, the power shaft could be made flexible.

It is to be understood that the present invention is not limited to the embodiments described above, but encompasses any and all embodiments within the scope of the following claims.

I claims:

1. A concrete finishing apparatus having a center of gravity comprising:

a motor having a power shaft extending therefrom, said power shaft having an axis of rotation, a proximal end fixed to said motor, and a distal end disposed spaced apart from said motor;

a disk having a center, and means for connecting said disk to said distal end of said power shaft at said center of said disk, said disk having abrasive material disposed thereon; and a handle located between said motor and said disk, wherein said handle has opposed ends, is attached to said motor, and is disposed to occupy a plane which is normal to said rotational axis of said power shaft and passes through the center of gravity of said concrete finishing apparatus, said handle having two terminal grips parallel to one another and perpendicular to said axis of rotation, each disposed at one end of said handle, said terminal grips disposed opposite from one another on opposing sides of said rotational axis of said power shaft so as to balance said tool when said tool is held with said disk in any position relative to gravity.

2. The concrete finishing apparatus according to claim 1 wherein said disk is circular in shape.

3. The concrete finishing apparatus according to claim 1, further including control means for varying the speed of said power shaft, said control means attached to said concrete finishing apparatus on said handle.

* * * * *